US005285061A

United States Patent [19]

She et al.

[11] Patent Number: 5,285,061

[45] Date of Patent: Feb. 8, 1994

[54] AN X-RAY PHOTOCATHODE FOR A REAL TIME X-RAY IMAGE INTENSIFIER

[75] Inventors: Yongzheng She; Shizheng Chen, both of Shanghai, China; Weilou Cao; Yanhua Shih, both of Ellicott City, Md.

[73] Assignee: CSL Opto-Electronics Corp., Ellicott City, Md.

[21] Appl. No.: 937,213

[22] Filed: Aug. 28, 1992

[51] Int. Cl.[5] ..... H01J 40/14; H01J 40/06

[52] U.S. Cl. ..... 250/214 VT; 313/542; 313/103 R

[58] Field of Search ..... 250/214 VT, 207; 313/542, 526, 528, 103 R, 103 CM, 105 CM

[56] References Cited

U.S. PATENT DOCUMENTS

| | | | |
|---|---|---|---|
| 3,681,606 | 8/1972 | Tinney | 250/214 VT |
| 3,710,125 | 1/1973 | Jacobs et al. | 250/214 VT |
| 4,069,438 | 1/1978 | Houston et al. | 378/28 |
| 4,150,315 | 4/1979 | Yang | 378/31 |
| 4,365,150 | 12/1982 | Bateman | 250/207 |
| 4,691,099 | 9/1987 | Johnson | 250/214 VT |
| 4,730,107 | 3/1988 | Enck, Jr. et al. | 250/214 VT |
| 4,737,623 | 4/1988 | Uhl | 250/207 |
| 4,814,599 | 3/1989 | Wang | 250/214 VT |
| 5,192,861 | 3/1993 | Breskin et al. | 250/214 VT |

OTHER PUBLICATIONS

Wilson et al., *Opto Electronics An Introduction,* 2nd. Ed., 1989, pp. 270–273.

*Primary Examiner*—Michael Messinger
*Attorney, Agent, or Firm*—Whitham & Marhoefer

[57] ABSTRACT

A direct conversion X-ray photo-electron cathode has specially designed secondary electron emission layers which provides high efficiency, low noise, high speed and broad band X-ray photon detection. The X-ray photocathode is integrated with a micro channel plate and an output phosphor display screen to form a panel type X-ray intensifier. The X-ray intensifier is combined with a micro-focus X-ray source to provide projection type X-ray microscope for use in X-ray microscopic diagnostic applications.

9 Claims, 2 Drawing Sheets

AN X-RAY PHOTOCATHODE FOR A REAL TIME X-RAY IMAGE INTENSIFIER

BACKGROUND OF THE INVENTION

1. Field of the Invention

The present invention generally relates to X-ray image intensifiers and, more particularly to an X-ray microscope utilizing a direct conversion X-ray photocathode in conjunction with an electron multiplier.

2. Description of the Prior Art

X-ray to visible converters are well known in the art but generally use indirect conversion techniques, where an X-ray image is converted to visible light in a scintillator, the visible light (photons) are then converted to a corresponding electron image, and the electrons are multiplied and strike a phosphor display screen to provide an enhanced directly viewable visible image. There are numerous disadvantages in having to convert an X-ray image to a visible light image before generating and multiplying a corresponding electron image. Conversion of an X-ray image to a visible light image is normally accomplished by using a scintillator, as described in U.S. Pat. Nos. 4,104,516, 4,040,900, 4,255,666, and 4,300,046. In each instance, the scintillator exhibits a limited response time, poor spacial resolution and sensitivity, and due to the complicated fabrication techniques and the attendant requirement to use light shielding, the cost is prohibitive.

In panel type X-ray image intensifiers, scintillation noise also becomes a problem, which mostly comes from the exponential pulse height distribution of the micro channel plate (MCP) gain.

SUMMARY OF THE INVENTION

It is therefore an object of the present invention to provide a photo-electron cathode, having specially designed secondary electron emission layers, which will directly convert an X-ray image to an equivalent electron image, while exhibiting high efficiency, low noise, high speed and a broad band x-ray photon detection capability.

The shortcomings of the prior art have been effectively overcome by designing a direct conversion X-ray photo-electron cathode consisting of a heavy metal layer which functions as an X-ray absorber, and a transmission secondary electron emission layer which functions as an electron multiplier with a multiplication factor of twenty or more. It has been found that by increasing the number of input electrons per channel of the MCP by a factor of twenty or more, the scintillation noise is drastically reduced. In the instant case, this is accomplished by using a compound multiplier, which is a direct conversion type X-ray photocathode consisting of two parts. The first being a heavy metal layer, which acts as an X-ray absorber, and the second part being a transmission secondary electron emission layer. The high energy photoelectrons produced in the heavy metal layer are multiplied by the secondary electron emitter to a factor of twenty or more. Due to this design, the noise of the intensifier is reduced and the sensitivity of the X-ray photocathode is increased, especially in the high energy, X-ray region.

A new panel type X-ray intensifier may be made by integrating this new direct conversion X-ray cathode, a micro channel plate and an output display fluorescent screen.

A portable projection type X-ray microscope may be made by using the above X-ray intensifier, a microfocus X-ray source and a personal computer (PC) based image processing system. The energy of the X-ray can be adjusted and the magnification can be changed by adjusting the distance between the X-ray source and the object. The low noise and high sensitivity of the intensifier make it possible to achieve a large magnification. A sub-micron X-ray microscope has also been designed for sub-micron X-ray diagnostic purposes.

According to the invention, there is provided a photo-electron cathode, for use in an X-ray microscope, capable of directly converting an X-ray image to an equivalent electron image which shows a substantially improved sensitivity and a very low scintillation noise in the high energy X-ray region of the frequency spectrum.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
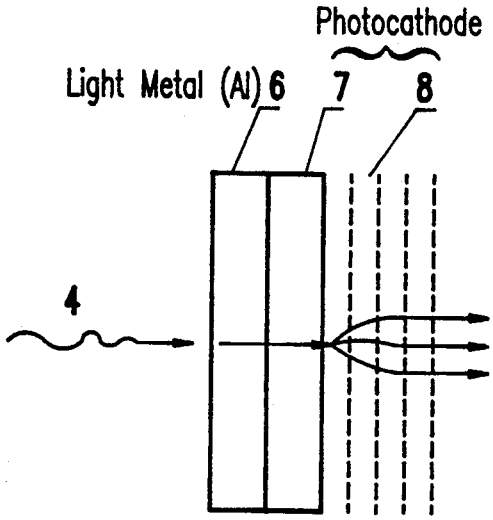
FIG. 1 shows the direct conversion compound X-ray photo-electron cathode of this invention.

Referring now to the drawings, and more particularly to FIG. 1, there is shown a diagram of the X-ray photocathode. Element 6 is a substrate of light metal, such as aluminum. The thickness is selected to assure its withstanding the attraction force from the high static electric field and does not attenuate the X-ray intensity significantly. For 35–80 KV X-ray, a 50 μm aluminum foil is suitable. Element 7 is the heavy metal layer of the X-ray photocathode, which is a layer of tantalum, tungsten, lead, bismuth, or gold. The optimum thickness depends on the energy of the X-ray photon, the L or K series critical excitation voltage and the density of the heavy metal. Table 1 gives the optimum thickness of different heavy metals for 35–80 KV X-ray.

TABLE 1

OPTIMUM THICKNESS OF DIFFERENT HEAVY METALS.

| Energy of X-Ray (KV) | 35 | 40 | 45 | 50 | 60 | 65 | 70 | 80 |
|---|---|---|---|---|---|---|---|---|
| Optimum Thickness (μm) | | | | | | | | |
| W | 0.50 | 0.70 | 0.95 | 1.2 | 1.9 | 2.3 | | |
| Ta | 0.40 | 0.85 | 1.1 | 1.5 | 2.2 | 2.7 | | |
| Au | 0.40 | 0.60 | 0.80 | 1.1 | 1.7 | | 2.5 | 3.4 |
| Pb | 0.65 | 1.0 | 1.5 | 2.0 | 3.2 | | 4.7 | 6.4 |
| Bi | 0.60 | 0.95 | 1.4 | 1.9 | 3.1 | | 4.6 | 6.2 |

Element 8 is the transmission secondary electron emission layer of the X-ray photocathode, which comprises one of the following materials which have a high secondary electron emission coefficient: CsI, CsBr, KCl, CsCl or MgO. The cesium iodide or cesium bromide layer can be coated in high vacuum for a high density profile, or in certain pressure of inert gas, such as argon, for a low density profile. The optimum thickness of the cesium iodide or cesium bromide layer depends on the energy of the photoelectron produced in the heavy metal layer which is determined by the selection of the X-ray energy and the specific heavy metal. For 60 KV X-ray and gold layer, the optimum thickness of the cesium iodide layer is approximately 7.4 μm for high density profile and 370 μm for low density profile, respectively. For the other heavy metals, the optimum thickness of the normal and low density alkali halides, respectively, in μms would be as follows: Bi-6.8/340, Ta-8.2/410, Pb-7.0/350, and W-8.1/405. The secondary electron conduction (SEC) gain of a low density profile cesium iodide layer can be as high as 100. The low density profile of a cesium iodide or cesium bromide layer can be prepared by evaporating the bulk material in argon with pressure of about 2 torr, the resulting relative density of the layer is about 2%. A cesium iodide secondary electron emission layer is also coated on the input channel wall of the MCP. This emission layer has a high density sub-layer and a low density sub-layer. The high density sub-layer is 1–2 μm with density of approximately 50%. The low density sub-layer has a decreased density profile from the interface with the high density sub-layer to its emission surface. The density distribution profile starts from 50% at the interface and decreases to about 2% at the emission surface. The low density sub-layer is about 3–7 μm.

Figure 2:
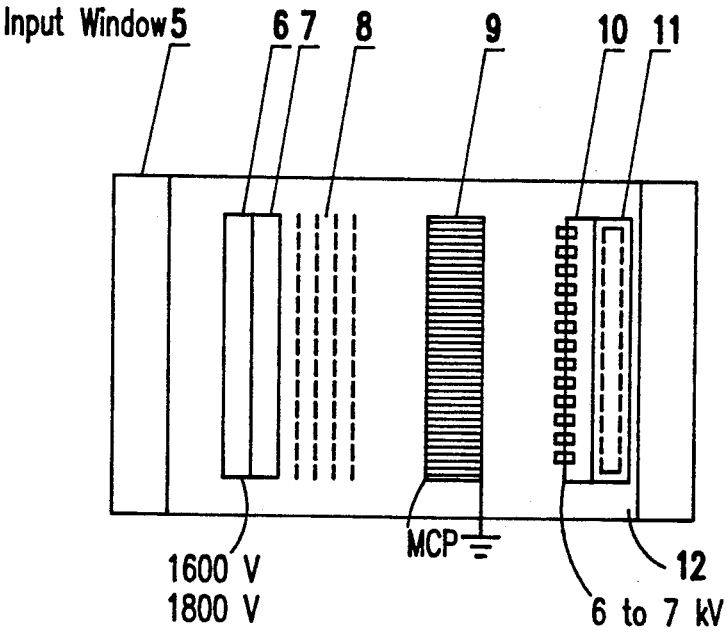
FIG. 2 shows a schematic diagram of a panel type X-ray image intensifier.

FIG. 2 is a schematic diagram of a panel type X-ray image intensifier, with element 5 being an input window. The window is made of 0.2 mm titanium foil. The thin Ti foil reduces the scattering of the incident X-ray and has an excellent transmission coefficient, especially for low energy X-rays. Element 9 is an MCP and element 10 is an output display fluorescent screen coated on a glass window 11. In operation, the voltage of the substrate 6 ranges between −1500 V and −2000 V, with the voltage of the input surface of the MCP at about −1000 V and with the output surface of the MCP grounded (V=0), the voltage of the output display fluorescent screen should be around +8000 V to +10000 V. The brightness of the image can be as high as 20 Cd/m$^2$. The diameter of the panel type X-ray image intensifier can be made from 50 mm to 200 mm with the thickness of the intensifier about 2 cm. This panel type X-ray intensifier has a 1:1 input and output image ratio and is vacuumed to $5\times10^{-7}$ torr in a glass or ceramic shell.

Figure 3:
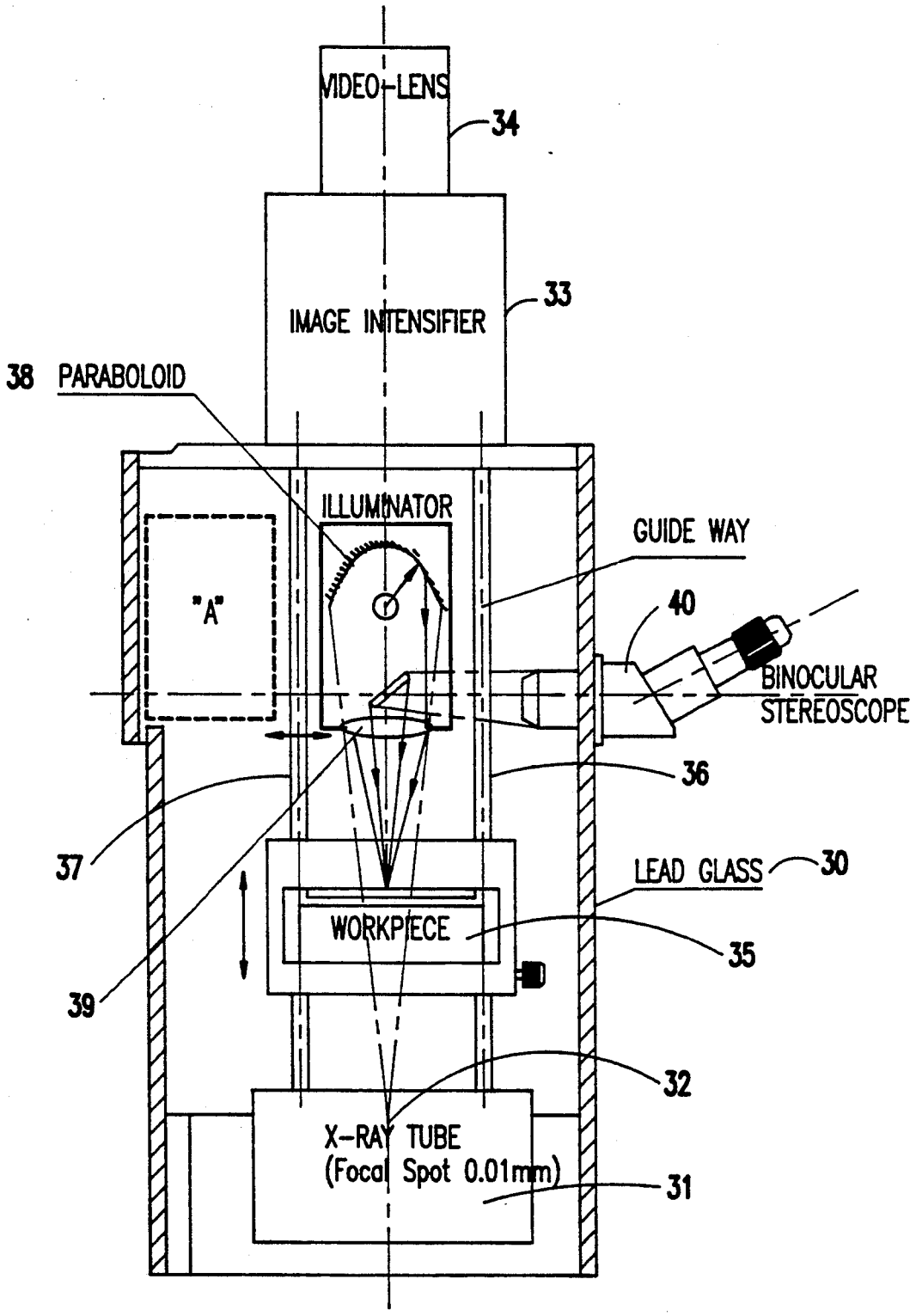
FIG. 3 depicts a portable projection type real time X-ray microscope incorporating the X-ray photocathode of FIG. 1.

FIG. 3 depicts a portable projection type real time X-ray microscope encased in a lead glass enclosure 30. An X-ray source, shown as X-ray tube 31 is mounted in one end of the enclosure and provides a 35 KV to 80 KV X-ray beam with a spot size falling between a micron and a sub-micron, as shown emanating from point 32. On the opposite end of the enclosure 30 is mounted an X-ray image intensifier 33, as described in FIG. 2, and is separated therefrom by about 300 mm to 1,000 mm, depending on the specific application. The videocamera 34 actually represents the means for viewing the X-ray image presented at the output of the image intensifier and can be either directly viewed or recorded by video. A vertically adjustable workpiece 35 is mounted on a pair of transport rails 36 and 37 for adjusting the position of the item under study. The geometrical amplification is therefore adjustable continuously from 1 to 1,000 times. A parabolic illuminator 38 is for illumination of the object. The co-axial optical microscope 40 and lens 39 are used for the alignment of the object under test. The illuminator 38 and lens 39 will be moved to position "A" during the test.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A direct conversion X-ray photocathode comprising:

a thin substrate of light metal having a thickness of approximately 50 μm;

a layer of heavy metal selected from the group consisting of tantalum, tungsten, lead, bismuth and gold, deposited on one surface of the light metal substrate to provide an X-ray absorber; and at least one layer of secondary emissive material deposited on the layer of heavy metal, the combination of the secondary emissive material and the heavy metal layer being an independent cathode for electron multiplication.

2. The X-ray photocathode of claim 1, wherein said substrate of light metal is aluminum and the materials selected for said layer of heavy metal and said layer of secondary electron emissive material function to form a compound electron multiplier.

3. The X-ray photocathode of claim 2, wherein said at least one layer of secondary emissive material is selected from the group of materials consisting of CsI, CsBr, DCl, CsCl and MgO.

4. The X-ray photocathode of claim 3, wherein the optimum thickness of the heavy metal layer is determined by the energy of the incident X-rays interecepted by the photocathode in accordance with the following table

| Energy of X-Ray (KV) | 35 | 40 | 45 | 50 | 60 | 65 | 70 | 80 |
|---|---|---|---|---|---|---|---|---|
| Optimum Thickness (μm) | | | | | | | | |
| W | 0.50 | 0.70 | 0.95 | 1.2 | 1.9 | 2.3 | | |
| Ta | 0.40 | 0.85 | 1.1 | 1.5 | 2.2 | 2.7 | | |
| Au | 0.40 | 0.60 | 0.80 | 1.1 | 1.7 | | 2.5 | 3.4 |
| Pb | 0.65 | 1.0 | 1.5 | 2.0 | 3.2 | | 4.7 | 6.4 |
| Bi | 0.60 | 0.95 | 1.4 | 1.9 | 3.1 | | 4.6 | 6.2 |

5. The X-ray photocathode of claim 4, wherein said secondary emissive material is CsI grown on the heavy metal layer to exhibit a normal density profile for 60 KV of X-ray energy and whose optimal thickness in μms is selected in accordance with the heavy metal used as the X-ray absorber to correspond to thicknesses of 8.2 for W, 7.0 for Pb, 8.2 for Ta, 6.8 for Bi and 7.4 for Au.

6. The X-ray photocathode of claim 4, wherein said secondary emissive material is a low density layer of CsI for 60 KV X-ray energy and whose optimal thickness in μms is selected in accordance with the heavy metal used as the X-ray absorber to correspond to thicknesses of 405 for W, 350 for Pb, 410 for Ta, 340 for Bi and 370 for Au.

7. A panel type direct conversion real time X-ray image intensifier, comprising:

an input window having a high transmission coefficient for X-rays, with the capability of reducing the scattering of incident X-rays intercepted by the photocathode;

a direct conversion, photo-electron cathode having a light metal substrate of sufficient thickness to withstand the attraction force from an applied static electric field, an X-ray absorbing heavy metal layer, and a cathode electron emitter functioning as a compound secondary electron emitter;

a microchannel plate, having input and output surfaces; and a phosphor display screen for providing an output image, such that an X-ray image impinging on the input window is transmitted to the direct conversion photo-electron cathode where said X-ray image is converted to an equivalent electron image which is enhanced by secondary electron multiplication within the cathode electron emitter and then by accelerating the electrons and further multiplication within the microchannel plate, the electron image strikes the phosphor display screen to effect and output image.

8. The X-ray image intensifier of claim 7, wherein the microchannel plate has a 3–7 μm layer of material, selected from the group consisting of CsI and CsBr, deposited in two stages to form two distinct sub-layers on the input surface thereof, which exhibits a non-uniform density profile across a first sub-layer exhibiting approximately a 50% density profile, and a second sub-layer which decreases in density from the interface with the first sub-layer to its surface.

9. The X-ray photocathode of claim 1 wherein the at least one layer of secondary electron emissive material function as an independent cathode and comprises at least two sub-layers of materials having different densities, with the first sub-layer having a density of approximately 50% and the second sub-layer exhibits a decreasing density profile from the interface with the high density first layer to its output emission surface.

* * * * *